US006789490B2

(12) United States Patent
Schmidt

(10) Patent No.: US 6,789,490 B2
(45) Date of Patent: Sep. 14, 2004

(54) SHIP CONSTRUCTIONS FOR ACHIEVING STABILITY AT HIGH SPEED THROUGH THE USE OF MULTIPLE, LOW WAVE-MAKING RESISTANCE, SUBMERGED HULLFORM PODS AND CONTROL FINS

(75) Inventor: Terrence Wayne Schmidt, Santa Clara, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/078,729

(22) Filed: Feb. 19, 2002

(65) Prior Publication Data

US 2003/0154896 A1 Aug. 21, 2003

(51) Int. Cl.[7] ..... B63B 1/00; B63B 1/28

(52) U.S. Cl. ..... 114/61.12; 114/280

(58) Field of Search ..... 114/61.1, 61.12, 114/61.14, 61.15, 274, 280, 281, 282, 283, 292

(56) References Cited

U.S. PATENT DOCUMENTS

| | | | | | |
|---|---|---|---|---|---|
| 1,753,399 | A | * | 4/1930 | Blair | 114/61.12 |
| 2,159,410 | A | * | 5/1939 | Turkovich | 114/61.1 |
| 2,804,038 | A | * | 8/1957 | Barkla | 114/272 |
| 3,149,601 | A | | 9/1964 | Lang | |
| 3,447,502 | A | | 6/1969 | Leopold | |
| 3,847,103 | A | | 11/1974 | Takeuchi | |
| 3,896,755 | A | * | 7/1975 | Marbury | 114/126 |
| 4,552,083 | A | | 11/1985 | Schmidt | |
| 4,763,596 | A | * | 8/1988 | Yoshida | 114/256 |
| 4,798,153 | A | | 1/1989 | Schmidt | |
| 5,237,947 | A | * | 8/1993 | Manning | 114/61.16 |
| 5,433,161 | A | * | 7/1995 | Loui | 114/61.14 |
| 5,535,690 | A | * | 7/1996 | Bystedt et al. | 114/61.2 |
| 5,592,895 | A | | 1/1997 | Schmidt | |
| 6,250,240 | B1 | * | 6/2001 | Thiger et al. | 114/61.12 |

OTHER PUBLICATIONS

Lockheed Martin "Reconfigurable SLICE ", published in mid to late 1998 by Lockheed Martin, Sunnyvale, CA.
Lockheed Martin "SLICE" brochure, published in mid to late 1998 by Lockheed Martin, Sunnyvale, CA.
SanJose Mercury News, photograph entitled "Slicing through the bay", published Apr. 1, 1999, San Jose, California.
Contra Costa The Times, Robert Oakes, article entitled SLICE shows its ferry potential, published Apr. 1, 1999, Contra Costa County, California.

* cited by examiner

*Primary Examiner*—Andrew Wright
(74) *Attorney, Agent, or Firm*—Donald C. Feix; Mark A. Wurm

(57) ABSTRACT

A ship designed to achieve high speed through the use of multiple, low wave-making resistance, submerged hullform pods is constructed for stable operation during maneuvers with and without a payload. Movable fins on the submerged hullform pods are constructed and are operable to provide the turning and to counteract an inertial moment produced by an elevated center of gravity of the ship so that the ship turns flat or rolls into a turn and does not roll out of a turn. A load balancing pod is movable fore-to-aft and side-to-side to balance the amount and the location of varied payloads on the ship. The movement of the fins may be a tilting movement, or each fin can be maintained at a set angle but extendable out of and retractable into a related pod to create the amount of side force needed for maneuvers and/or to control the amount of lift that might be needed during operation of the ship.

26 Claims, 10 Drawing Sheets

$F_{CP}$ = SIDE FORCE DUE TO PORT CANARD DEFLECTION
$F_{CS}$ = SIDE FORCE DUE TO STARBOARD CANARD DEFLECTION
$F_{SP}$ = SIDE FORCE DUE TO PORT STABILIZER DEFLECTION
$F_{SS}$ = SIDE FORCE DUE TO STARBOARD STABILIZER DEFLECTION
$Y_H$ = SHIPS HULL SIDE FORCE

• FIN FORCES CANCEL (APPROXIMATELY) IN ROLL

• SHIP ROLLS OUT DUE TO INERTIA

• $Y_H$ OFFSET FROM C.G.

• FIN FORCES CANCEL (APPROXIMATELY) IN ROLL

• SHIP ROLLS OUT DUE TO INERTIA

• $Y_H$ OFFSET FROM C.G.

• FIN MOMENTS OPPOSE INERTIA MOMENTS-- PRODUCES FLAT TURNS OR ROLLS INTO TURNS

• FORWARD FIN MOMENTS LARGER THAN AFT FIN MOMENTS RESULTANT IN INERTIA MOMENTS THAT PRODUCES FLAT TURNS OR ROLLS INTO TURNS (VARYING FIN AREA AT CONSTANT ANGLE) VS (ANGLE AT CONSTANT AREA)

- REDUCES RESISTANCE WHEN FINS NOT NEEDED ARE RETRACTED
- USE BEST FIN (INBOARD OR OUTBOARD)
- MAXIMUM EFFECTIVENESS USE OF BOTH FINS

SHIP CONSTRUCTIONS FOR ACHIEVING STABILITY AT HIGH SPEED THROUGH THE USE OF MULTIPLE, LOW WAVE-MAKING RESISTANCE, SUBMERGED HULLFORM PODS AND CONTROL FINS

FIELD OF THE INVENTION

This invention relates to a ship of the kind designed to achieve high speed through the use of multiple, low-wave making resistance, submerged hullform pods.

This invention relates particularly to a ship which is constructed to have stable operation during maneuvers with and without a payload.

BACKGROUND OF THE INVENTION

My prior U.S. Pat. No. 5,592,895 issued Jan. 14, 1997; my U.S. Pat. No. 4,552,083 issued Nov. 12, 1985 and my U.S. Pat. No. 4,798,153 issued Jan. 17, 1989 illustrate and describe a small water plane area high speed ship of the general kind to which this invention relates.

Ships of this kind (ships which are designed to achieve high speed through the use of multiple, low-wave making resistance, submerged hullform pods) can present unique problems in operations (particularly in operations at high speeds with substantial payloads) as compared to the operation of a conventional monohull ship operating at lower speeds.

For example, one unique problem that can occur with a ship of this kind is a problem of undesired roll out of the ship in a turn. The roll out can result from an inertial moment produced by an elevated center of gravity of the ship.

In prior art ships of this kind fins associated with the submerged hullform pods were used to steer the ship and were also used to control roll of the ship. In the prior art the functions (steering and roll control) were independent. If the fins were positioned to control roll, the settings substantially reduced the steering to the point where it could be necessary to turn off roll control in order to get steering; and, when trying to control roll, the ship could be caused to change heading. The fore and aft fins of prior art ships could be set to offset the rolling moment caused by each other, but these prior art ships had no control power remaining to counteract the roll due to inertia. The prior art fore and aft fins were, in effect, adversely coupled so that using the fins to steer produced a roll moment which was additive to the roll moment produced by the inertia of the ship.

A proper load balance can be another problem.

Efficient and effective use of control fins on the associated submerged hullform pods can be another unique problem with ships of this kind.

It is a primary object of the present invention to eliminate or to overcome such unique problems by novel methods and apparatus of the present invention.

It is a specific object of the present invention to construct and to operate fin means on each pod which are effective to provide the turning and to counteract the inertia moment produced during the turning of the ship so that the ship does not roll out of the turn.

SUMMARY OF THE INVENTION

The ship of the present invention is designed to achieve high speed through the use of multiple, low wave-making resistance, submerged hullform pods.

The ship of the present invention comprises a superstructure which is constructed for operation above the surface of the water.

A first pair of transversely spaced fore struts extend downwardly from the superstructure.

A second pair of transversely spaced aft struts extend downwardly from the superstructure. The second pair of aft struts is longitudinally spaced from the first pair of fore struts.

A low wave-making resistance hullform pod is attached to each strut to provide a pair of transversely spaced fore pods and a pair of transversely spaced aft pods located beneath the superstructure.

In one embodiment of the invention a propulsion propeller is located at the rear of each pod on at least one pair of said fore and aft pods.

In another embodiment of the invention a propulsion propeller is located at the front of each pod on at least one pair of the fore and aft pods.

In another embodiment of the invention a propulsion water jet is located at the rear of each pod on at least one pair of the fore and aft pods.

Each pod is configured to have a longitudinal length which is shorter than the length of the ship and a transverse diameter which is large enough to enable the pods to provide all or substantially all of the buoyancy required to maintain the superstructure above the surface of the water during the propulsion of the ship.

Each pod has one or more fins operatively associated with the pod. Each fin is movable with respect to the associated pod (under the control of the operator of the ship or under automatic control) for controlling the ship during maneuvers and/or for providing additional lift as needed.

The movement of the fin with respect to the pod may be a tilting of the fin, or the movement may be an extension of the fin outwardly of the pod or a retraction of the fin inwardly of the pod, depending upon the specific embodiment of the present invention.

It is an important feature of the present invention that the fins on the pods are constructed and are effective to provide the turning and to counteract the inertia moment produced during the turning of the ship so that the ship does not roll out of a turn. The fin and pod constructions of the present invention produce flat turns or rolls into turns.

In another embodiment of the present invention a fifth pod is used for additional buoyancy and load balancing.

The payload of a ship may vary, and larger payloads may require more buoyancy. The use of a fifth pod provides additional load carrying capacity. In the present invention the fifth pod can be moved fore-or-aft or side-to-side to balance the location of the payload on the ship.

The fifth pod can be constructed to have a propulsion propeller (and a self-contained motor and driver mechanism located entirely within the pod) for additional propulsion capability.

In another specific embodiment of the present invention the pod can be retracted when it is not needed, such as, for example, after a part of the payload has been expended or off-loaded. This lowers the drag.

The individual pods are each large enough to enable the motor and all drive mechanism to be contained within the interior of the pod. This has a benefit in permitting all of the weight of the drive mechanism to be located forward in the ship to provide better load balance (with the payload placed on the aft part of the superstructure of the ship). This permits the center of gravity to be maintained close to the center of buoyancy of the ship.

In other specific embodiments of the present invention all of the fins, instead of being pivotal, are maintained at a set angle, but the length of the fin projecting from the associated pod is varied by extending the fin outwardly of the pod and by retracting the fin inwardly into the pod. The fin is driven back and forth under the control of the operator to create the amount of side force needed for maneuvers and/or to control the amount of lift that might be needed during different operations of the ship. The amount of power needed to extend or to retract a fin is less than the amount of power needed to tilt a fin with respect to the pod. Less structure is required and the mechanism is simplified.

In a specific embodiment of the present invention each pod has a fin which can be projected from and retracted into the one side of the pod and another fin which can be projected from and retracted into the other side of the pod. This embodiment permits using the best fin (the outboard fin or the inboard fin) for a particular purpose. This embodiment also permits maximum effectiveness by using both fins on a single pod.

Ship constructions, methods and apparatus which incorporate the features described above and which are effective to function as described above constitute further, specific objects of the invention.

Other and further objects of the present invention will be apparent from the following description and claims and are illustrated in the accompanying drawings, which by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

BRIEF DESCRIPTION OF THE DRAWINGS

FIG. 2A shows forces generated by the aft pods and fins during a turning movement of the ship in a rightward direction (as illustrated in the upper plan view of FIG. 4). In FIG. 2A the inclination of the fin on each associated pod (for producing the turning motion of the ship) is indicated at the left and right sides of FIG. 2A.

FIG. 2B shows the forces generated by the fore pods and fins during a turning movement of the ship in a rightward direction (as illustrated in the upper plan view of FIG. 4). In FIG. 2B the inclination of the fin on each associated pod (for producing the turning motion of the ship) is indicated at the left and right sides of FIG. 2B.

FIG. 3 shows certain forces and turning moments involved during the turning movement of a conventional, prior art ship having a conventional hull and rear rudder structure.

FIG. 5A shows the forces generated by the aft pods and fins during a turning movement of the ship in a rightward direction (as illustrated in the upper plan view of FIG. 4). In FIG. 5A the inclination of the fin on each associated pod (for producing the turning motion of the ship) is indicated at the left and right sides of FIG. 5A.

FIG. 5B shows the forces generated by the fore pods and fins during a turning movement of the ship in a rightward direction (as illustrated in the upper plan view of FIG. 4). In FIG. 5B the inclination of the fin on each pod (for producing the turning motion of the ship) is indicated at the left and right sides of FIG. 5B.

FIG. 8 illustrates how the mounting means for the fifth strut and the fifth pod permit varying the position of the pod with respect to the superstructure so that the location of the fifth pod can be used to balance the load on the ship.

FIG. 10 (and associated FIG. 11) illustrate how the center of gravity of the ship can cause the ship to tend to roll out of a turn because of the roll due to the inertia of the ship. In FIG. 10 the deflection of the fins on the fore pods tend to make the ship roll into the turn, the deflection of the fins on the aft pods tend to roll the ship into the turn, and when these two fin forces pretty much cancel each other out as far as the roll goes, the center of gravity of the ship above the waterline can produce an inertia moment which tends to roll the ship out of the turn. At high speed, as will be described in more detail below in the Detailed Description, the roll due to the inertia moment can be substantial.

FIGS. 12 and 13 show how the center of gravity of the ship can produce an inertia moment which tends to roll the ship out of a turn when the roll moments produced by the pairs of fore and aft fins are substantially equal (so as to cancel each other).

FIG. 19 illustrates a prior art construction in which the drive mechanism for the propulsion propellers at the ends of the submerged pods is located in the superstructure and is connected to the propellers by a connecting drive assembly. In the prior art twin pod structure illustrated in FIG. 19 the buoyancy provided by the two pods is pretty much distributed, so the center of buoyancy tends to be at midship. The addition of a load to the rearward part of the superstructure (as illustrated in phantom outline in FIG. 19) tends to shift the center of gravity to the rear, as indicated by the arrow in FIG. 19. This is undesirable in this particular twin pod ship construction, because the weight of the drive machinery located at the rear of the ship accentuates the difference between the location of the center of gravity and the location of the center of buoyancy of the twin pod ship.

FIG. 20 shows how the drive mechanism for the propulsion propellers can be located entirely within the relatively large diameter fore pods so as to locate the weight of the drive mechanism forward. When a load is added to the rear part of the ship of FIG. 20, the center of gravity is shifted longitudinally rearward so as to be in substantial registry with the center of buoyancy, as indicated by the arrow in FIG. 20.

FIG. 21 is taken along the line and in the direction indicated by the arrows 21—21 in FIG. 2.

Figure 21:
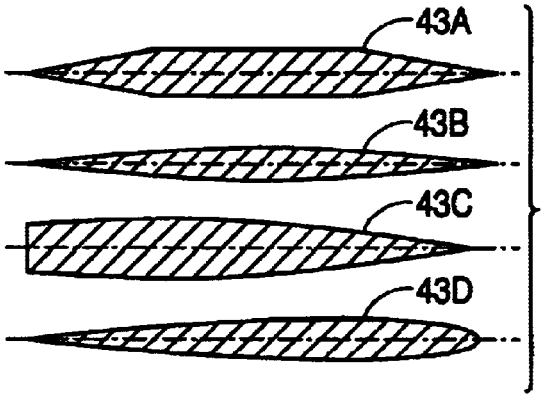
FIG. 21 shows four cross section, plan views of different hull section shapes of struts which can be used with the ship shown in FIG. 1.

The top view in FIG. 21 shows a strut 43A made out of flat facets for ease of fabrication.

The second from the top strut 43B is lenticular, and the two arcs have sharp corners that the flat facet strut does not have, so the lenticular shape has some improved flow over the flat facet strut.

The third strut 43C from the top in FIG. 21 shows a base ventilated strut. This strut eliminates the cavitation and separation occurring on a conventional foil at high speed.

The strut 43D shown in the lower most part of FIG. 21 is an air foil shape strut which is generally similar to the lenticular strut but has a rounded leading edge. The sharper leading edge of the lenticular strut 43B causes less spray. The rounded leading edge of the strut 43D produces less drag and provides more area for the strut.

Figure 22A:
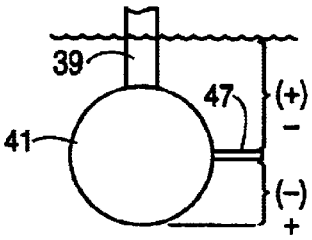
Figure 22B:
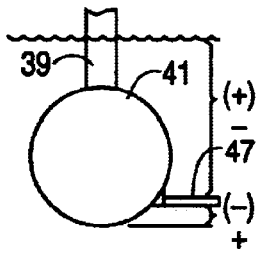
Figure 22C:
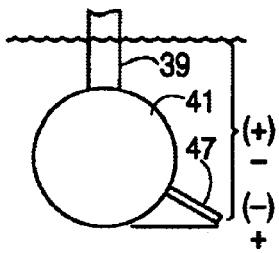

FIG. 22 is a composite of three individual views (FIG. 22(A), FIG. 22(B) and FIG. 22(C)). Each individual view is an end elevation view of one of the four pods of a ship of the kind shown in FIG. 1. These three views show variations of the way in which the fin can be mounted on the hull of a pod. With respect to each pod there are six places where the fins could be located, considering the inboard and outboard locations.

FIG. 22(A) shows the pod having a fin projecting from substantially the mid point in the height of the pod.

FIG. 22(B) shows the fin mounted near the keel of the pod.

FIG. 22(C) shows the fin mounted near the keel and also inclined downwardly so that the tip of the fin is substantially level with the bottom of the keel of the pod.

The objective sought to be achieved in deflecting a fin is to maximize the side force.

The locations of the mountings of the fin in FIGS. 22(B) and 22(C) are preferred over the FIG. 22(A) location because (as illustrated by the size of the brackets indicating the magnitude of the plus and minus forces respectively above and respectively below the fin in each fin mounting location) the lower mounting locations of the fin either minimize or eliminate the degradation of the effect (that is desired to be achieved) by the tilting or deflection of the fin during maneuvering of the ship. The locations shown in FIGS. 22(B) and 22(C) either minimize or eliminate the degradation of the side force (due to the area below the tip of the fin) with the tip of the fin near or at the base line of the pod. The objective is to maximize the side force created by the fin. In FIG. 22(A) there is a substantial degradation of the side force due to the difference in the forces above and below the fin and the surfaces on which the forces act. In FIG. 22(B) the degradation is reduced by reducing the area below the fin. In FIG. 22(C) the degradation is virtually eliminated.

Figure 1:
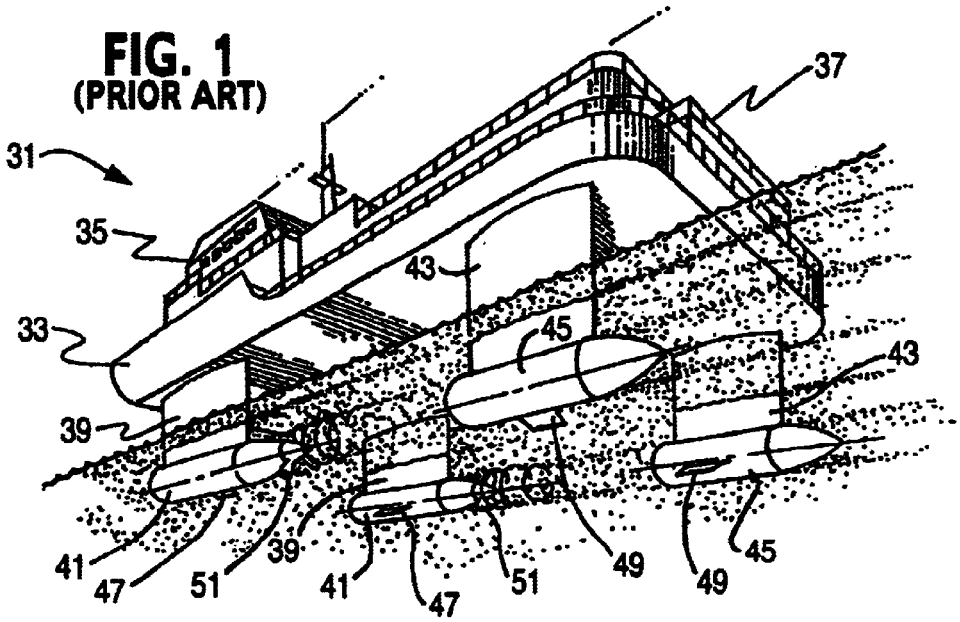
FIG. 1 (PRIOR ART)
FIG. 1 is an isometric view of a ship of the kind designed to achieve high speed through the use of multiple, low wave-making resistance, submerged hullform pods. The ship shown in FIG. 1 may be constructed to incorporate one or more embodiments of the present invention, as described in more detail below.
Figure 23:
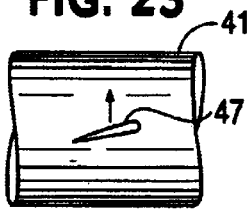

FIG. 23 is a fragmentary enlarged view of a fin projecting from one of the four pods of the ship shown in FIG. 1. FIG. 23 shows how a tilt of the fin at the angle shown in FIG. 23 produces a lift force on the associated pod.

Figure 24:
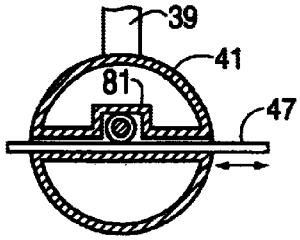

FIG. 24 is an end elevation view, partly in cross section, through one of the four pods of the kind shown in the ship of FIG. 1 of the drawings. FIG. 24 (like related FIGS. 25, 26 and 27) shows an actuating mechanism for retracting the fin of a pod into the interior of the pod and for projecting the fin out of the pod with the fin positioned at a set angle so that the amount of the side force and/or the amount of lift needed can be controlled by the extent to which the fin is extended outwardly of the pod. In FIG. 24 the fin can be extended either entirely outboard of the pod or entirely inboard of the pod or partly outboard and partly inboard of the pod. In FIG. 24 the fin is illustrated as located at about the mid-point of the height of the pod.

Figure 25:
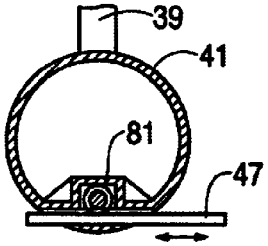

FIG. 25 is a view like FIG. 24 but shows the fin and actuating mechanism located near the bottom of the pod so as to be positioned nearly at the keel line.

Figure 26:
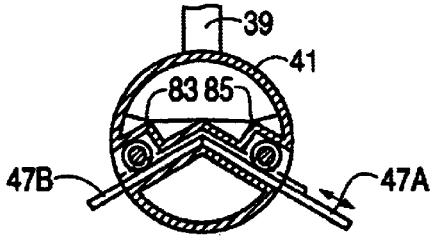

FIG. 26 shows a construction in which the fins are inclined at a downward angle so that, when a fin is substantially fully projected outwardly of the pod, the outer edge of the fin is positioned at substantially the keel line of the associated pod. FIG. 26 shows a construction in which the fin and actuating mechanism may also incorporate a second inclined and projectable fin on a side of the pod opposite that having the first inclined and projectable fin. FIG. 26 provides a construction in which the resistance can be reduced when the fins are not needed by retracting at least a substantial portion of the fins within the pod when the fins are not needed. FIG. 26 also shows a construction in which use can be made of the best fin (inboard or outboard) for a particular maneuver by projecting that fin and by retracting the opposite fin.

Figure 27:
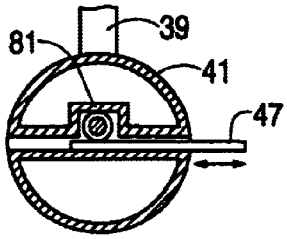

FIG. 27 shows a construction in which the fin may be completely retracted within the pod when a fin is not needed and in which the fin may be projected out either side of the pod as needed for a particular maneuver.

DESCRIPTION OF THE PREFERRED EMBODIMENTS

FIG. 1 is an isometric view of a ship of the kind designed to achieve high speed through the use of multiple, low wave-making resistance, submerged hullform pods. The ship is indicated by the general reference numeral 31 in FIG. 1 and may be constructed to incorporate one or more embodiments of the present invention, as will be described in more detail below.

The ship 31 has a superstructure 33.

A control bridge 35 is located at a forward portion of the superstructure, and a load 37 is carried behind the bridge and on the rearward portion of the superstructure 33.

The superstructure 33 is constructed for operation above the surface of the water, as illustrated in FIG. 1.

The floatation and buoyancy for the ship 31 is provided by struts and submerged hullform pods.

A first pair of transversely spaced fore struts 39 extend downwardly from the superstructure 33.

A low wave-making resistance hullform pod 41 is attached to each strut 39.

A second pair of transversely spaced aft struts 43 extend downwardly from the superstructure 33. The second pair of aft struts 43 is also longitudinally spaced from the first pair of fore struts 39.

A low wave-making resistance hullform pod 45 is attached to each strut 43.

Each pod 41 has a fin 47, and each pod 45 has a fin 49.

Figure 2:
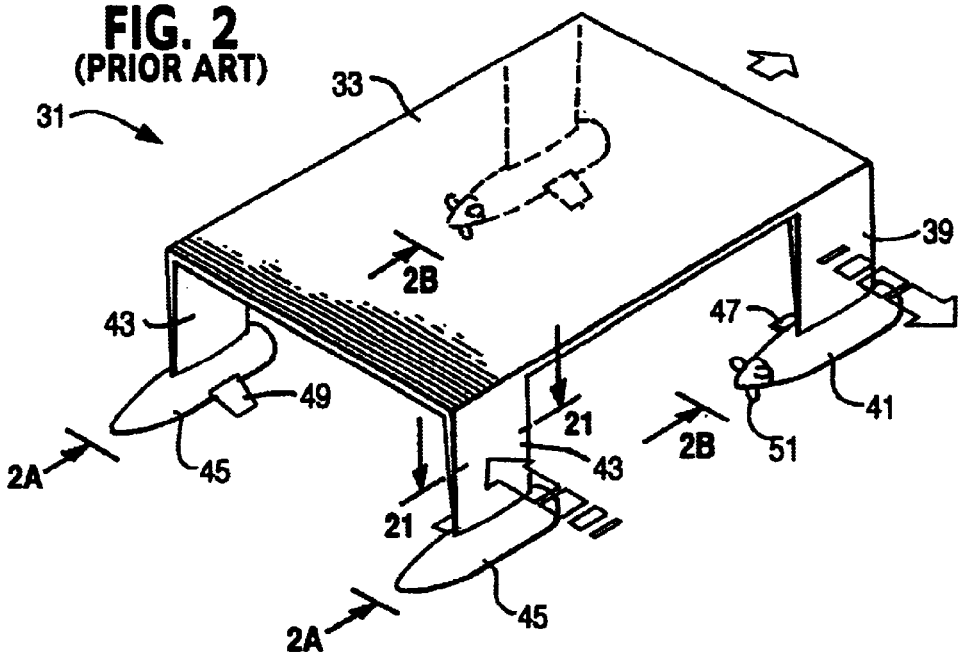
FIG. 2 (PRIOR ART)
FIG. 2 is an isometric view showing in diagrammatic form certain components of the ship illustrated in FIG. 1. In the embodiment shown in FIG. 2 each fin on each pod projects inboard from the pod.
Figure 2A:
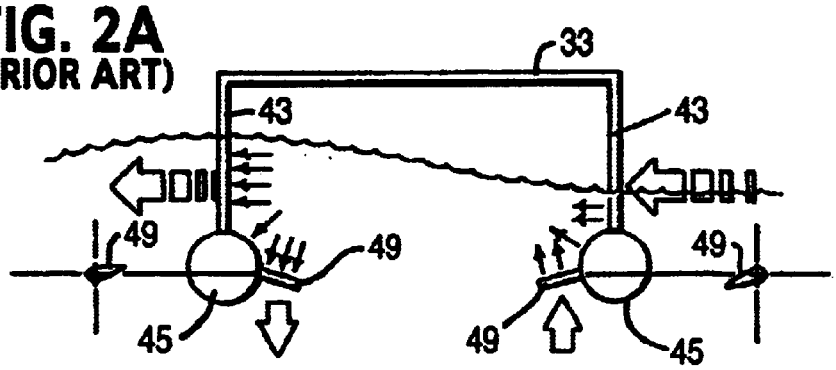
FIG. 2A (PRIOR ART)
FIG. 2A is an elevation view taken along the line and in the direction indicated by the arrows 2A—2A in FIG. 2.
Figure 2B:
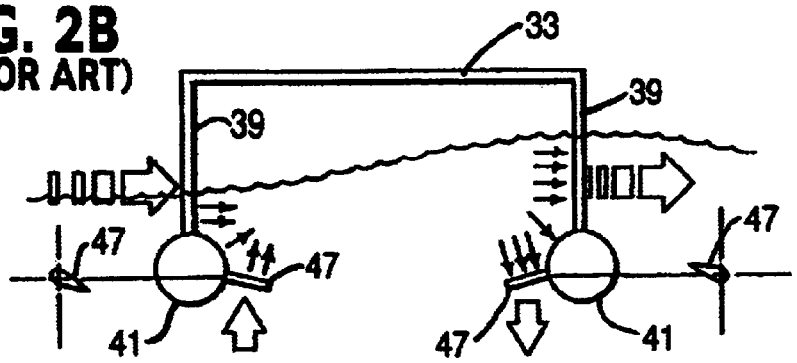
FIG. 2B (PRIOR ART)
FIG. 2B is an elevation view taken along the line and in the direction indicated by the arrows 2B—2B in FIG. 2.
Figure 5:
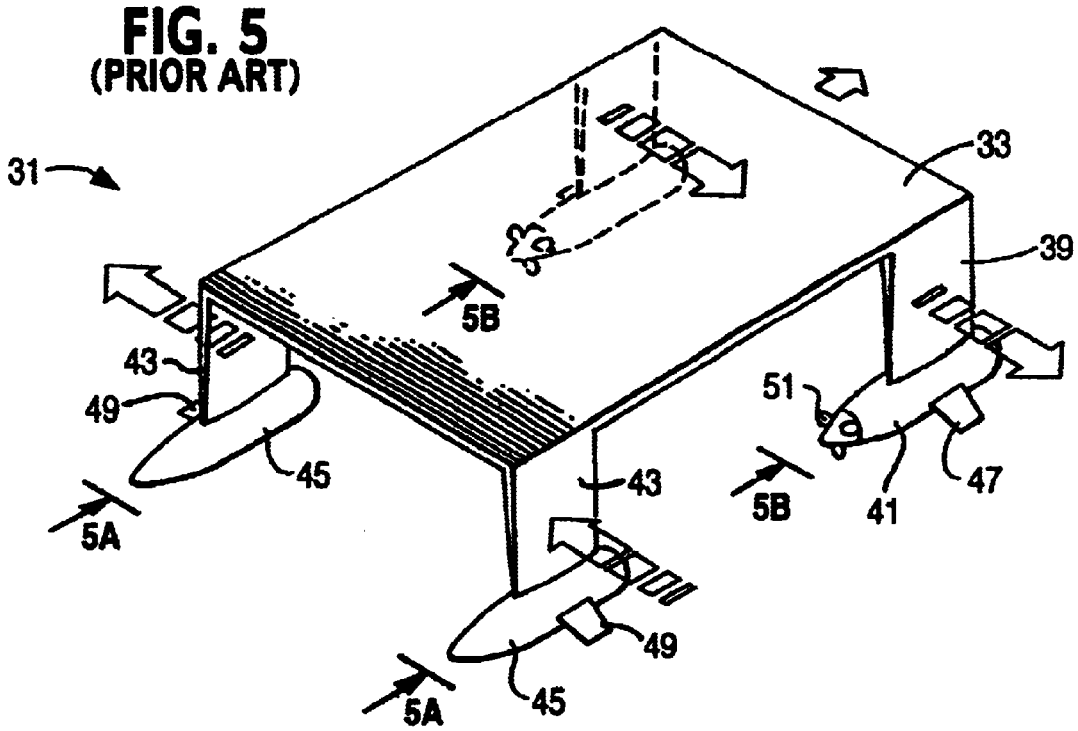
FIG. 5 (PRIOR ART)
FIG. 5 is an isometric view showing in diagrammatic form certain components of the ship illustrated in FIG. 1. In the embodiment shown in FIG. 5 each fin on each pod projects outboard from the pad.

As illustrated in FIGS. 2A and 2B, each of the fins 47 and 49 can be tilted with respect to the associated pod to steer the ship 31 a desired direction, without the use of a rudder, as will be described in more detail below.

A propulsion propeller 51 is associated with each of the fore pods 41 and is driven by a motor and a drive mechanism which are entirely contained within the interior of the pod 41, as will also be described in more detail with reference to FIG. 20. The propulsion propeller may be located on the rear of the pod or on the front of the pod. A propulsion water jet may be used at the rear of the pod in place of the propeller.

The ability to place all of the motor and drive mechanism within the interior of each fore pod 41 is beneficial for the stability of the ship 31. Positioning the drive mechanism and the weight of the drive mechanism forward on the ship 31 helps to position the center of gravity near the center of buoyancy of the ship 31. This is especially helpful when a payload 37 is placed on the rear part of the superstructure 33 (as will be described in more detail below with reference to FIG. 20).

FIGS. 2, 5, 6, 7, 10, 12, 14, and 16 are isometric views showing in diagrammatic form certain components of the ship 31 illustrated in FIG. 1. In these different embodiments of the present invention corresponding components are indicated by the same reference numerals.

One of the problems that can be encountered with a ship like the ship 31, which has submerged flotation pods 41 and 45 and an elevated superstructure 33 for carrying a payload above the water level is a problem of maintaining the desired attitude of the ship during maneuvers, particularly during hard turns at high speeds.

In order to make a turn with the ship 31, the fins on the fore pods must be positioned in a way which is different from the way in which the fins are positioned on the aft pods. There has to be a difference in the side forces produced on the respective fore and aft pairs of struts and pods in order to move the ship 31 in the desired direction.

Figure 4:
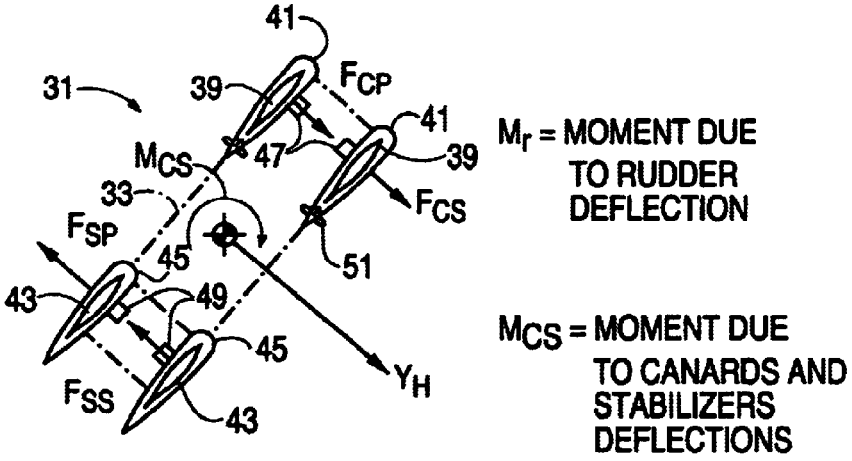
FIG. 4 (PRIOR ART)
FIG. 4 is a top plan view (like FIG. 3) but shows certain forces and turning moments involved during the turning of the ship illustrated in FIG. 1 and having the components illustrated in diagrammatic form in FIGS. 2, 2A and 2B.
Figure 5A:
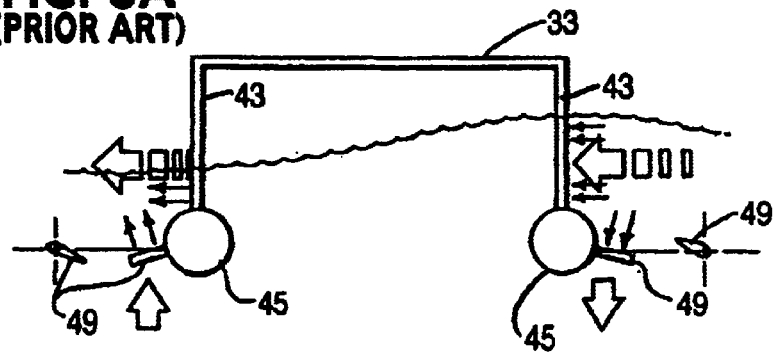
FIG. 5A (PRIOR ART)
FIG. 5A is an elevation view taken along the line and in the direction indicated by the arrows 5A—5A in FIG. 5.
Figure 5B:
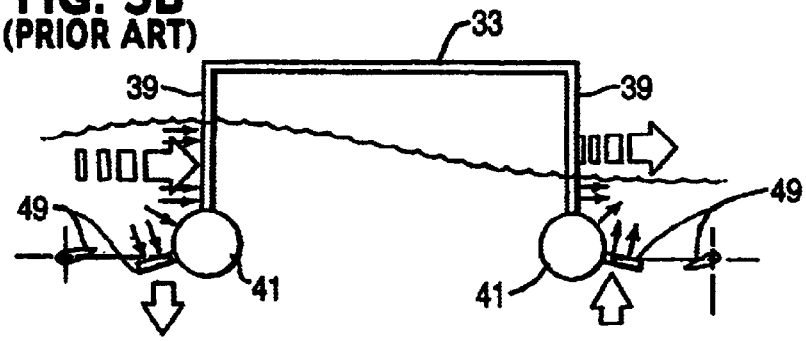
FIG. 5B (PRIOR ART)
FIG. 5B is an elevation view taken along the line and in the direction indicated by the arrows 5B—5B in FIG. 5.
Figure 6:
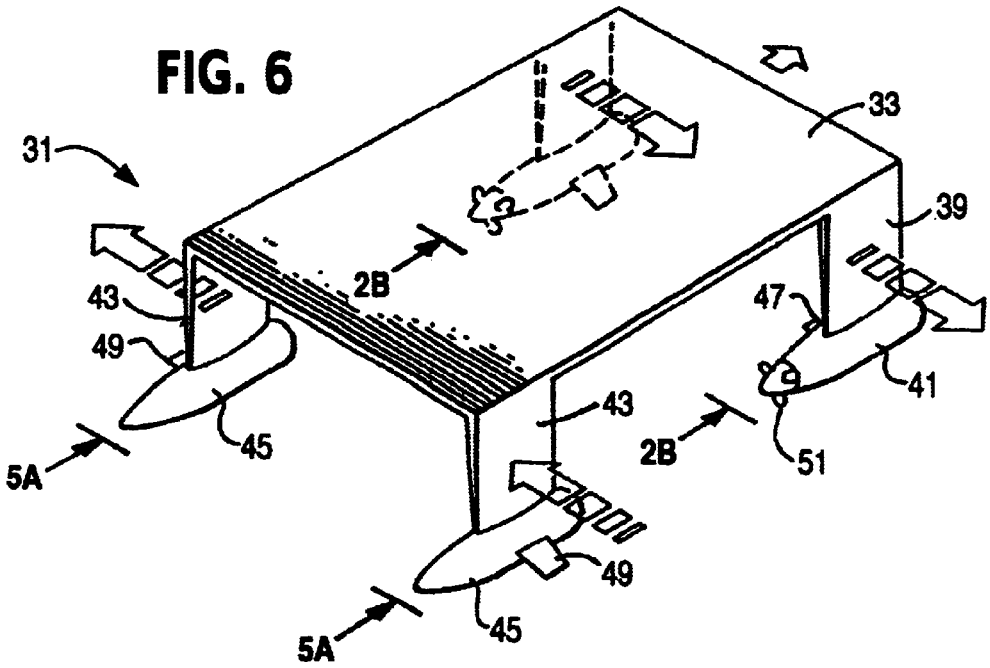
FIG. 6 is an isometric view in diagrammatical form (like FIG. 2 and FIG. 5) showing another embodiment of the present invention. In the embodiment shown in FIG. 6, each fin on each of the fore pods projects inboard from the pod and each fin on each aft pod projects outboard from the pod. In the FIG. 6 embodiment the forces generated by the fore pods and fins during a turning movement of the ship in the rightward direction are essentially the same as shown in FIG. 2B. In the embodiment shown in FIG. 6 the forces generated and the roll movements produced by the aft pods are essentially like those illustrated in FIG. 5A. Accordingly, an elevation view behind the fore pods is indicated along the line and in the direction indicated by the arrows 2B—2B in FIG. 6; and an elevation view from behind the aft pods is indicated along the line and by the arrows 5A—5A in FIG. 6.
Figure 7:
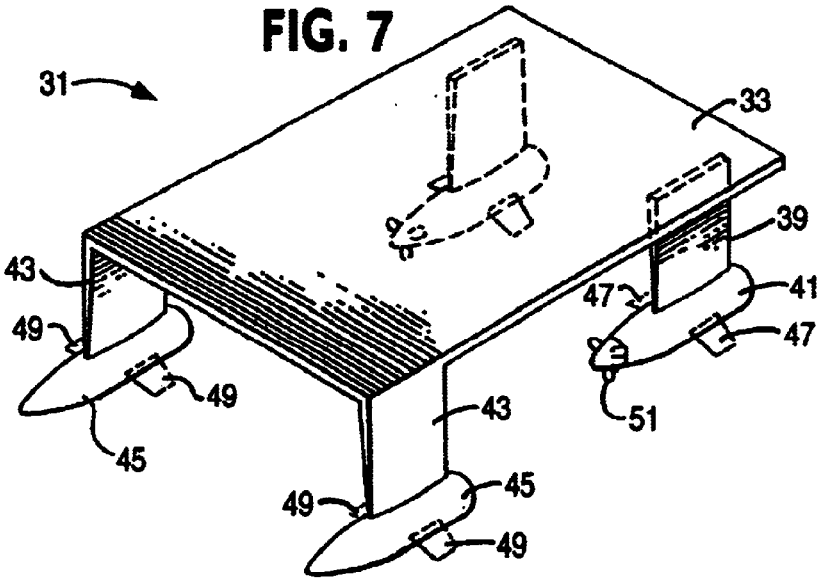
FIG. 7 is an isometric view in diagrammatic form (like FIGS. 2, 5 and 6) showing another embodiment of the present invention. In the FIG. 7 embodiment each of the pods has one fin projecting outboard of the pod and has another fin projecting inboard of the pod. In the embodiment shown in FIG. 7, the transverse spacing between the struts of the pair of fore pods is smaller than the transverse spacing between the struts of the pair of aft pods.

For example, in order to make a turn to starboard (or to the right as viewed in the top plan of FIG. 4) the fins 47 on the pair of fore pods 41 must be tilted to produce side forces $F_{CP}$ and $F_{CS}$ as viewed in FIG. 4. These side forces on the fore pods 41 and struts 39 tend to shift the forward part of the ship 31 downward and to the right (as viewed in FIG. 4).

The fins 49 on the aft pods 45 must be tilted in a direction to produce side forces $F_{SS}$ and $F_{SP}$. These side forces on the aft struts and tends to shift the rearward part of the ship 31 up and to the left (as viewed in top plan in FIG. 4). The resultant of these two forces produces a turning moment $M_{CS}$ and a resultant ship's hull side force $Y_H$ which causes the ship 31 to move in a rightward turn (in the direction indicated in FIG. 4).

The desired attitude for the ship 31 during this turn is to have the ship 31 either stay flat during the turn or to roll into the turn.

However, because of the difference in the inertia moment produced by the vertical height between the center of gravity CG of the ship 31 (particularly when there is a substantial load 37 on the superstructure 33) and the underwater hull side forces and the moments produced by the pairs of fore and aft pods and fins, there can be a resultant moment which tends to roll the ship 31 out of the turn.

The various forces and moments involved will be described in more detail below with particular reference to FIGS. 2A and 2B and FIGS. 10 and 11 of the drawings and then by a comparison with the forces and moments illustrated in FIGS. 14–17 of the drawings.

Figure 3:
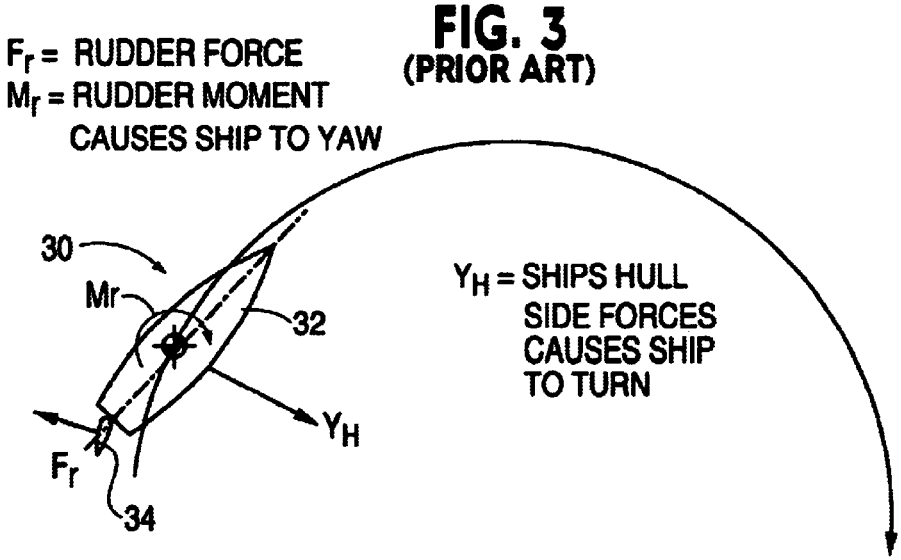
FIG. 3 (PRIOR ART)
FIG. 3 is a diagrammatic top plan view showing a prior art, conventional ship having a conventional hull and rear rudder structure.

As illustrated in FIG. 3, rolling out of a turn is generally not a problem with a prior art, conventional ship 30 having a conventional monohull 32 and rear rudder structure 34.

In the prior art, conventional ship 30 having the conventional monohull 32 and rear rudder structure 34, the inclination of the rudder 34 produces a rudder force $F_r$ which produces a moment $M_r$ about the center of gravity of the ship as illustrated in FIG. 3. The moment produced by the inclination of the rudder causes the ship 30 to yaw in the direction indicated in FIG. 3. The force $Y_H$ on the ship's hull produced by the yaw then forces the ship to turn in the direction indicated in FIG. 3. In a ship like the ship 30 the center of gravity of the ship is usually near or below the waterline so that there is no substantial inertia moment produced during a turn which would tend to cause the ship 30 with a conventional hull to roll out of the turn.

With the ship 31 of the present invention, the center of gravity of the ship, particularly when loaded, is located enough above the waterline as to be capable of producing a moment due to inertia which can tend to roll the ship 31 out of the turn.

The fin means for initiating the turns of the ship 31 of the present invention must therefore be constructed and must operate effectively to counteract the inertia moment produced during turning of the ship.

One example of the roll moments fore and aft and the side forces produced by the tilting of the fins 47 on the fore pods 41 and by the tilting of the fins 49 on the aft pods 45 will now be described with particular reference to FIGS. 2A and 2B.

The roll moment resulting from the inertia of the elevated center of gravity C.G. will be described with particular reference to FIGS. 10 and 11.

As illustrated in FIG. 2A, (1) when the inwardly projecting port stabilizer fin 49 is tilted to the position shown at the left hand side of FIG. 2A and (2) when the inwardly projecting starboard stabilizer fin 49 is tilted to the position indicated at the right hand side of FIG. 2A, the rear part of the ship 31 is caused to start moving outwardly (as viewed in FIG. 4). There is a difference in the water depth produced above the port and starboard fins (and associated pods) as illustrated in FIG. 2A. The water depth builds up over the port pod and fin. The force exerted on the aft pods 45 and the aft struts 43 are directed to the left as shown by the block arrows in FIG. 2A and as indicated by the force arrows $F_{SP}$ and $F_{SS}$ in FIG. 4.

The side forces acting on the pods 45 and the struts 43 are shown by the horizontally oriented block arrows in FIG. 2A, and the vertical forces produced by the tilting of the fins shown in FIG. 2A are indicated by the vertically oriented block arrows shown in FIG. 2A. The vertically aligned block arrows produce a counter clockwise moment on the aft or rearward part of the ship 31 (as indicted by the curved arrow in FIG. 10).

As illustrated in 2B when the port conard fin 47 is deflected to the position shown at the left side of FIG. 2B and when the starboard conard fin 47 is deflected to the position shown at the right side of FIG. 2B, the side forces produced cause the forward part of the ship 31 to move inwardly and downwardly (as viewed in the plan view of FIG. 4). The side forces are indicated by the horizontally extending block arrows shown in FIG. 2B. The vertical forces are shown by the up and down block arrows shown in FIG. 2B. The vertical forces produce a clockwise moment (as indicated by the curved arrow in FIG. 10) which is opposed to the counter clockwise moment which is produced by the aft pods and fins shown in FIG. 2A.

The moment produced by the oppositely directed side forces is the moment $M_{CS}$ shown in FIG. 4 and results in a ship's hull side force $Y_H$ in the starboard direction as illustrated in FIG. 4.

Figure 10:
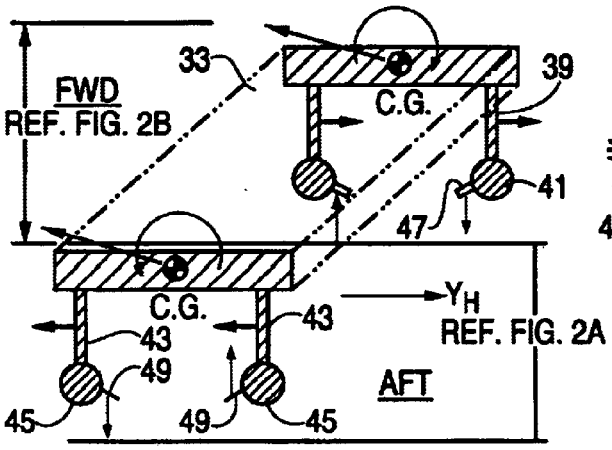
FIG. 10 is an isometric view in diagrammatic form like FIG. 2 showing a construction in which each fin on each pod projects inboard from the pod.
Figure 11:
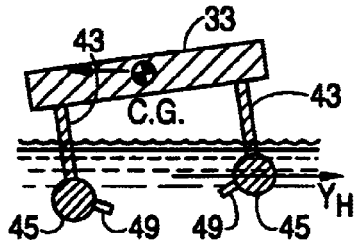
FIG. 11 is an end elevation view of FIG. 10 and illustrates how the location of the center of gravity of the ship above the waterline can produce the inertia moment which tends to roll the ship out of the turn when the ship is being turned in a rightward direction (as viewed in FIG. 4).

Turning now to FIGS. 10 and 11, the possible problem of having the ship roll out due to inertia will now be described.

If the construction and operation of the fins and associated pods are such that the forces of the pair of fore fins 47 produce a rolling movement which is approximately equal to the oppositely directed rolling movement produced by the forces of the pair of aft fins 49, then the fin forces cancel each other (approximately) in the roll direction of the ship 31. But there can still be a problem of the ship tending to roll out due to inertia. The vertical offset of the center of gravity C.G. of the ship 31 from the resultant hull force $Y_H$ acting on the struts and pods can produce a roll moment in the counter clockwise direction.

As best illustrated in FIG. 11 this inertia moment can cause the ship 31 to roll out (of a turn to the starboard) by causing the ship 31 to tilt to the left as viewed in FIG. 11.

This problem can arise with a number of different orientations of the fins with respect to the pods.

The problem has been described immediately above with reference to orientations in which all of the fins project inboard of the associated pods (as illustrated FIGS. 2, 2A, 2B, 4, 10 and 11.

The problem can also arise when each fin on each pod projects outboard of the pod. This orientation is shown in FIGS. 5, 5A, 5B, 12 and 13.

Figure 12:
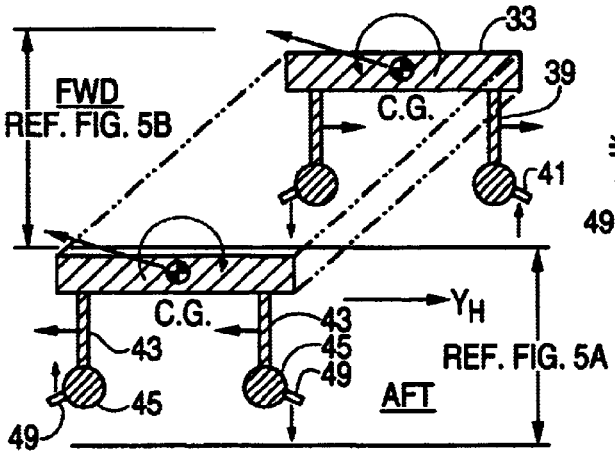
FIGS. 12 and 13 are views like FIGS. 10 and 11 but showing a construction in which each fin on each pod projects outwardly of the pod (like FIG. 5).
Figure 13:
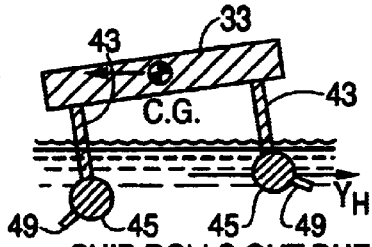

FIGS. 12 and 13 show how, when the fin forces cancel (approximately) in roll so that the counterclockwise roll produced by the fore fins 41 counteract and substantially equal the clockwise moment produced by the aft fins 49 (as indicated by the counterclockwise and clockwise arrows in FIG. 12), there can still be a problem of the ship tending to roll out of the turn due to inertia resulting from the vertical offset between the elevated center of gravity of the ship 31 and the ship's hull side force $Y_H$ acting on the submerged hull form pods and struts.

In accordance with the present invention, the fin means on each pod must be constructed and effective to counteract the inertia moment produced during turning of the ship so that the ship either stays flat during the turning or rolls into the turn, rather than rolling out of the turn.

Figure 14:
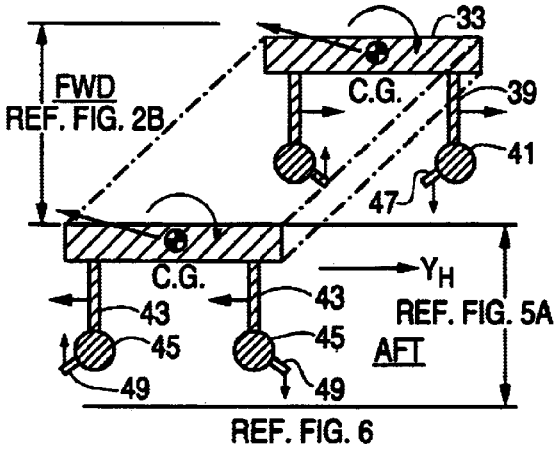
FIGS. 14 and 15 are views like FIGS. 10 and 11 but showing a construction like FIG. 6 wherein each of the pair of fore pods has a fin projecting inwardly and each of the pair of aft pods has a fin projecting outwardly. The construction and function of the embodiment shown in FIGS. 14 and 15 (in which the fins on the aft pods project outboard from the pods) allows the ship to be rolled into the turn or to have a rolling moment that will as a minimum counteract the inertia moment and produce a flat turn.
Figure 16:
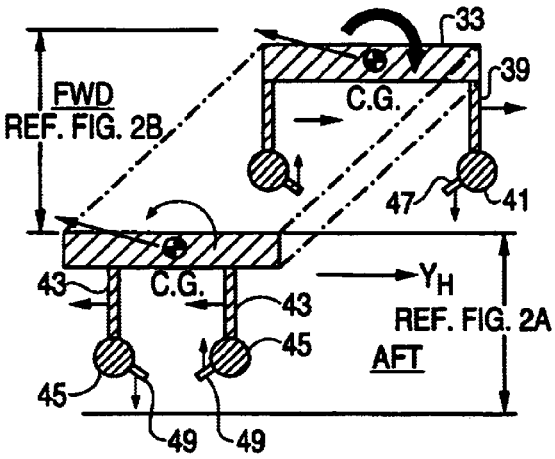
FIGS. 16 and 17 are views like FIGS. 14 and 15 but show a construction in which each fin on each pod projects inboard of the pod. In the FIGS. 16 and 17 embodiment the transverse spacing between the struts of the fore pods is greater than the transverse spacing between the struts of the aft pods so as to produce a roll moment by the fore pods and fins which is enough larger then the opposite roll moment of the aft fins as to counteract the inertia moment of the ship and to produce flat turns or rolls into turns.

The fin means may be constructed to counteract each other fore and aft (as shown in FIG. 16) or may be constructed and operated to produce roll moments in the same direction fore and aft (as shown in FIG. 14). But in either case the combination of the roll moments must have a direction and a combined magnitude sufficient to counteract the inertia moment produced during turning of the ship in a particular direction.

Figure 15:
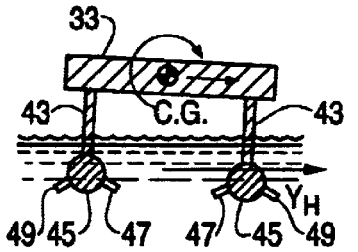

In the FIGS. 14 and 15 embodiment the fore pods 41 have fins 47 projecting inboard and the aft pods 45 have fins 49 projecting outboard. This construction produces roll moments in the same clockwise direction (as indicated by the arrows in FIG. 14). The sum of these two fore and aft roll movements is equal to or greater than the inertia moment and are in a direction to counteract the counterclockwise acting inertia roll moment so that, as illustrated in FIG. 15, the ship 31 rolls into the turn.

Figure 17:
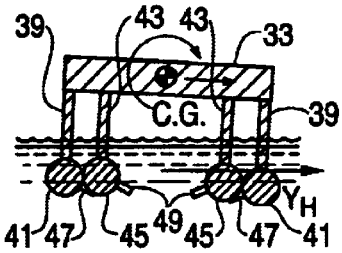

In the embodiment illustrated in FIGS. 16 and 17 the roll movement produced by the pair of fore pods and inwardly projecting fins 47 is in a clockwise direction (as indicated by the arrow). The roll moment produced by the pair of aft pods 45 and inwardly projecting fins 49 produce a roll moment in the counterclockwise direction (as indicated by the arrow in FIG. 16).

Figure 16A:
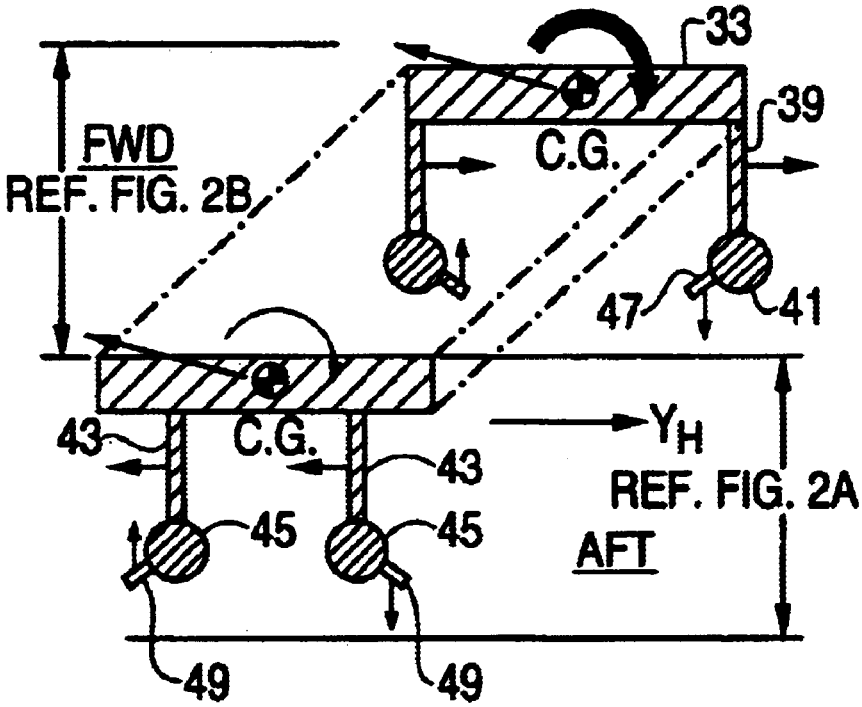
FIG. 16A illustrates each of the pair of fore pods having a fin projecting inwardly and each of the pair of aft pods having a fin projecting outwardly.

In the FIG. 16 embodiment the pair of fore struts 39 are spaced farther apart than the aft struts 43, and the roll moment in the clockwise direction is larger than the oppositely directed roll moment produced by the aft fins 49 in the counterclockwise direction. In FIG. 16A is shown an embodiment where the fore struts have a larger transverse spacing than the aft struts with the fore pods having fins projecting inboard and the aft pods having fins projecting outboard.

The resultant of these two roll moments is a roll moment in the clockwise direction which is sufficiently larger than the inertia roll moment exerted in the counterclockwise direction so that the resultant roll moment produced by the fins counteracts the inertia moment and produces flat turns or rolls into turns as (illustrated in FIG. 17).

Figure 8:
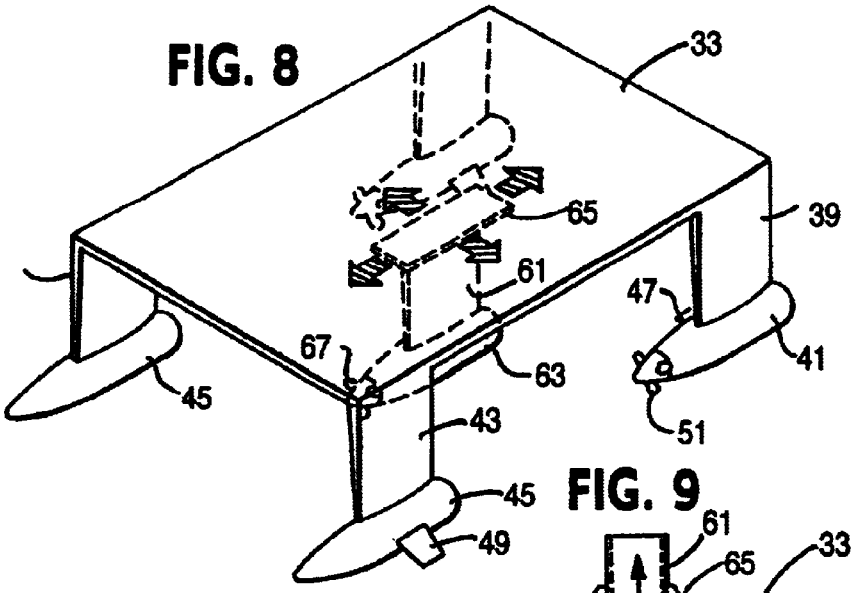
FIG. 8 is an isometric view in diagrammatic form (like FIGS. 2, 5, 6 and 7) showing another embodiment of the present invention. The embodiment shown in FIG. 8 illustrates how an additional fifth strut and fifth pod are located beneath the superstructure for providing additional buoyancy for the ship (over and above the buoyancy provided by the pairs of fore and aft pods).

FIG. 8 is an isometric view in diagrammatic form (like FIGS. 2, 5, 6, and 7) showing another embodiment of the present invention.

The embodiment shown in FIG. 8 illustrates how an additional fifth strut 61 and fifth pod 63 are located beneath the superstructure 33 for providing additional buoyancy for the ship 31 (over and above the buoyancy provided by the pairs of fore and aft pods 41 and 45).

FIG. 8 also illustrates how a mounting means 65 for the fifth strut 61 and fifth pod 63 permit varying the position of the pod 63 with respect to the superstructure 33 so that the location of the fifth pod 63 can be used to balance the amount of the payload 37 and the position of the payload 37 on the ship 31.

As indicated by the block arrows in FIG. 8 the mounting means 65 may not only mount the fifth pod 63 transversely between the pairs of fore struts 39 and aft struts 43 but also longitudinally between the pairs of fore struts and aft struts.

This capability of varying both the fore-and-aft and the side-to-side positioning of the fifth strut facilitates obtaining substantial alignment of the center of buoyancy with the center of gravity of the ship for various types and positionings of loads on the superstructure 33 of the ship 31. To balance the load 37 on the ship 31, the pod 63 can be moved fore-or-aft or side-to-side.

Figure 9:
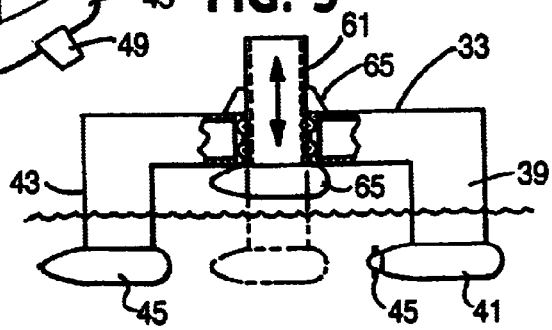
FIG. 9 is a side elevation view showing how the fifth strut and fifth pod of the FIG. 8 embodiment can also be mounted to permit complete retraction of the fifth pod out of the water when the added buoyancy of the fifth pod is not needed.

The mounting means 65 shown in FIG. 9 permit vertical positioning of the fifth strut 61 and fifth pod 63 so as to permit complete retraction of the fifth pod 63 out of the water when the added buoyancy of the fifth pod is not needed. This feature is beneficial in eliminating the drag of a fifth pod when the fifth pod is not needed for added buoyancy. If, for example, all or part of the payload 37 is expended at some point in the operation of the ship 31, the pod 63 can be retracted out of the water to reduce drag.

As illustrated in FIG. 8 the fifth pod 63 may also have a propulsion propeller 67 mounted on the rear of the pod 63. The drive means for the propulsion propeller 67 are contained entirely within the interior of the pod 63 (as will be described in detail below with respect with FIG. 20).

The weight distribution on a ship 31 of the kind having a superstructure supported above the waterline by submerged hullform pods and struts, can present problems which are quite different from the weight distribution on a conventional boat having a monohull.

This weight distribution problem will now be described with reference to FIGS. 18, 19 and 20.

In all ships, it is generally desirable to have the control bridge located forward for visibility and to be able to position the payload aft.

Figure 18:
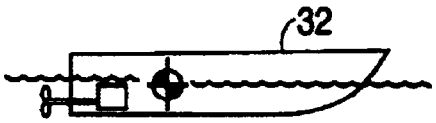
FIG. 18 (PRIOR ART)
FIG. 18 is a side elevation view of a prior art, conventional ship having a conventional hull and having a drive mechanism located generally below the waterline so as to produce a center of gravity and a center of buoyancy of the ship at approximately the waterline.

FIG. 18 shows a conventional boat 32 having a conventional monohull of the kind in which the bow is fine and the stem is broad. The broad stern provides a lot of buoyancy and can handle the weight aft.

Figure 19:
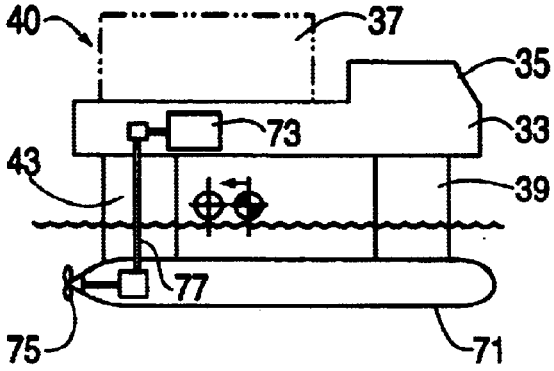
FIG. 19 (PRIOR ART)
FIG. 19 is a side elevation of a prior art ship construction of the kind having two long and relatively small diameter submerged pods and a superstructure positioned above the waterline.

FIG. 19 shows a prior art ship 40 having two long and relatively small diameter, transversely spaced, submerged pods 71. Each pod 71 is connected to the superstructure 33 by a fore strut 39 and an aft strut 43. Each pod 71 extends along all or substantial part of the length of the superstructure 33. Each pod 71 has a relatively small diameter because the required buoyancy is obtained as a result of the considerable length of the pod 71. Normally there is not enough room in the pod 31 to put the prime propulsion unit entirely within the interior of the pod 71. Instead, a motor 73 for driving a propulsion propeller 75 is mounted in the superstructure 73. The motor 73 is connected to the propulsion propeller 75 by an extended drive mechanism 77. This location of the drive mechanism 73 puts a significant amount of weight aft of the ship 40.

When a payload 37 is placed on the aft part of the superstructure 33, the center of gravity of the ship 40 is moved even further aft (as illustrated by the arrow in FIG. 19).

The center of buoyancy (provided by the two submerged pods 71) is distributed substantially evenly along the length of the pods, so that the center of buoyancy tends to be near midship. The longitudinal difference in the rearward location of the center of gravity and the midship location of the center of buoyancy is undesirable.

Figure 20:
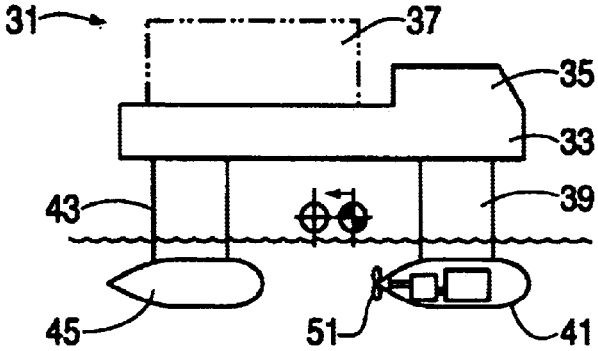
FIG. 20 is a diagrammatic side elevation view of an embodiment of the present invention.

In the present invention (as illustrated in FIG. 20) each of the pods 41 and 45 necessarily have a relatively large diameter in order to provide the required flotation. The length of each of the pods 41 and 45 is significantly shorter than the pod 71 shown in FIG. 19. Because of the relatively large internal diameter of each of the fore pods 41, the drive mechanism for the associated propulsion propeller 51 can be located entirely within the fore pod 41. This permits locating the weight of the drive mechanism forward. When a load 37 is then added to the rear part of the ship 31, the center of gravity (as shown in FIG. 20) is shifted longitudinally rearward (as indicated by the arrow in FIG. 20) so as to be in substantial registry with the center of buoyancy. This result is beneficial in enhancing and facilitating balancing of the ship 31 with the payload 37.

FIG. 21 is a top plan view taken along the line and in the direction indicated by the arrows 21—21 in FIG. 2. FIG. 21 shows four different configurations of section shapes of the struts which can be used with the ship shown in FIG. 1.

The top view in FIG. 21 shows a strut 43A made out of flat facets for ease of fabrication. The second from the top view in FIG. 21 shows a strut 43B which is lenticular. The two arcs have sharp corners that the flat facet strut 43A does not have. The lenticular shape of the strut 43B has some improved flow over the flat facet strut 43A.

The third strut 43C from the top in FIG. 21 has a blunt face at the trailing edge for high speed. At high speed the flow just separates prior to the trailing edge, so chopping off the trailing edge does not produce an increased resistance problem.

The bottom strut 43D shown in FIG. 21 is an air foil shape strut that is generally similar to the lenticular strut 43B, but the strut 43D has a rounded leading edge. The sharper leading edge of the lenticular strut 43B causes less spray. The rounded leading edge of the strut 43D produces less drag and produces more volume to surface area for the strut.

The vertical location of a fin on a related pod has an effect on the function produced by the fin.

This fin location and effect will now be described with reference to FIG. 22.

FIG. 22 is a composite of three individual views (FIG. 22(A), FIG. 22(B) and FIG. 22(C)). Each individual view is an end elevation view of one of the four pods of a ship of the kind shown in FIG. 1. These three views show variations of the way in which the fin can be mounted on the hull of the pod. There are six places the fins could be located on each pod, considering an inboard location and an outboard location with respect to each pod.

FIG. 22(A) shows a pod 41 having a fin 47 projecting from substantially the mid point in the height of the pod.

FIG. 22(B) shows the fin 47 mounted near the keel of the pod 41.

FIG. 22(C) shows the fin 47 mounted near the keel and also inclined downwardly so that the tip of the fin is substantially level with the bottom of the keel of the pod.

The locations of the mountings of the fin in FIGS. 22(B) and 22(C) are preferred over the FIG. 22(A) location because (as illustrated by the size of the brackets indicating the magnitude of the plus and minus forces respectively above and below the fin in each fin mounting location) the lower mounting locations of the fin either minimize or eliminate the degradation of the effect (that is desired to be achieved) by the tilting or projection of the fin during maneuvering of the ship. The locations shown in FIGS. 22(B) and 22(C) either minimize or eliminate the degradation of the side force (due to the area below the tip of the fin) with the tip of the fin near or at the base line of the pod.

FIG. 23 is a fragmentary enlarged view of a fin 47 projecting from a pod 41 of the ship 31 shown in FIG. 1. FIG. 23 shows how a tilt of the fin at the angle shown in FIG. 3 produces a lift force on the associated pod.

As a general rule, there is always some lift that is wanted on a ship to offset a bias toward sinking of the ship.

One of the features of the present invention is that a fin can be maintained at a set angle and then projected and retracted out of and into the associated pod 41 to create the amount of lift that is needed and/or to create the amount of side force that is needed during a particular maneuver.

The amount of power required to project and to retract a fin is quite low as compared to the amount of power that is required to rotate a fin.

Having a fin which can be retracted partially or entirely within the pod also reduces the resistance. Only the portion of the fin needed for control is exposed. And that portion of the fin which is needed for control is exposed only when control is needed.

FIGS. 24 through 26 illustrate further embodiments of this feature of the present invention.

FIG. 24 is an end elevation view, partly in cross section, through one of the four pods of the ship of FIG. 1 of the drawings. FIG. 24 (like related FIGS. 25, 26 and 27) shows an actuating mechanism 81 for retracting the fin 47 of a pod 41 into the interior of the pod and for projecting the fin out of the pod, with the fin positioned at a set angle, so that the amount of the side force and/or the amount of lift needed for operation of the ship 31 can be controlled by the extent to which the fin 47 is extended outwardly of the pod 41. In FIG. 24 the fin 47 can be extended either entirely outboard of the pod or entirely inboard of the pod or partly outboard and partly inboard of the pod. In FIG. 24 the fin is illustrated as located at about the mid-point of the height of the pod 41.

FIG. 25 is a view like FIG. 24 but shows the fin 47 and actuating mechanism 81 located near the bottom of the pod 41 so as to be positioned nearly at the keel line.

FIG. 26 shows a construction in which two fins 47A and 47B are each inclined at a downward angle so that, when either fin is substantially fully projected outwardly of the pod 41, the outer edge of the fin is positioned at substantially the keel line of the pod. FIG. 26 shows a construction in which the fin 47B has a first actuating mechanism 83 and a second actuating mechanism 85. The second actuating mechanism separately controls the position of the inclined and projectable fin 47A on the side of the pod opposite that having the first inclined and projectable fin 47B.

FIG. 26 provides a construction in which the resistance can be reduced when the fins are not needed by retracting at least a substantial portion of the fins within the pod when the fins are not needed.

FIG. 26 also shows a construction in which use can be made of the best fin (inboard or outboard) for a particular maneuver by projecting that fin and by retracting the opposite fin.

FIG. 27 shows a construction in which the fin 47 may be completely retracted within the pod 41 when a fin is not needed and in which the fin 47 may be projected out either side of the pod 41 as needed for a particular maneuver.

While I have illustrated and described the preferred embodiments of my invention, it is to be understood that these are capable of variation and modification, and I therefore do not wish to be limited to the precise details set forth, but desire to avail myself of such changes and alterations as fall within the purview of the following claims.

What is claimed is:

1. A ship of the kind designed to achieve high speed through the use of multiple, low wave-making resistance, submerged hullform pods, said ship comprising, a superstructure constructed for operation above the surface of the water, a first pair of transversely spaced fore struts extending downwardly from said superstructure, a second pair of transversely spaced aft struts extending downwardly from said superstructure, said second pair of aft struts being longitudinally spaced from the first pair of fore struts, a low wave-making resistance hullform pod attached to each strut to provide a pair of transversely spaced fore pods and a pair of transversely spaced aft pods located beneath said superstructure, propulsion means on each pod on at least one pair of said fore and aft pairs of pods, each pod being configured to have a longitudinal length which is shorter than the length of the ship and a transverse diameter which is large enough to enable the pods to provide all or substantially all of the buoyancy required to maintain said superstructure above the surface of the water during propulsion of the ship at normal operating speeds of the ship, fin means on each pod moveably constructed to provide turning and to counteract the inertia moment produced during the turning of the ship so that the ship does not roll out of a turn, and wherein the fin means produce fore and aft roll moments which are in the same direction with respect to one another.

2. The invention defined in claim 1 wherein the fin means on each of the two fore pods project inboard and the fin means on each of the two aft pods project outboard so that the ship can roll into the turn, using the fin means, to counteract the inertia forces of the ship.

3. The invention defined in claim 1 wherein the first pair of transversely spaced fore struts have a larger transverse spacing than the second pair of transversely spaced aft struts and wherein the fin means on each of the two fore pods project inboard and the fin means on each of the two aft pods project outboard so that the ship can roll into the turn, using the fin means, to counteract the inertia forces of the ship.

4. The invention defined in claim 1 including an additional fifth strut extending downwardly from said superstructure and an additional low wave-making resistance hullform pod attached to said fifth strut and located beneath said superstructure to provide additional buoyancy for the ship over and above the buoyancy provided by said pods attached to the first pair of transversely spaced fore struts and the second pair of transversely spaced aft struts wherein the fifth pod is positioned transversely between the pairs of struts and longitudinally between said pairs of struts.

5. The invention defined in claim 4 including propulsion means on said fifth pod.

6. The invention defined in claim 1 wherein each of the fin means of each of the pods extends from the associated pod at a location below the midline of the pod and wherein each fin means is inclined downwardly at an angle such that the outer edge of the fin means is positioned at substantially the keel line of the associated pod so that substantially all of the effective force produced by a fin means is exerted above the fin means.

7. The invention defined in claim 1 wherein the fin means on at least one of said pairs of pods are inclined at an angle to the horizontal so as to provide lift during forward motion of the ship.

8. The invention defined in claim 7 including mounting means in the pod for moving each inclined fin means inwardly and outwardly of each associated pod.

9. A ship of the kind designed to achieve high speed through the use of multiple, low wave-making resistance, submerged hullform pods, said ship comprising, a superstructure constructed for operation above the surface of the water, a first pair of transversely spaced fore struts extending downwardly from said superstructure, a second pair of transversely spaced aft struts extending downwardly from said superstructure, said second pair of aft struts being longitudinally spaced from the first pair of fore struts, a low wave-making resistance hullform pod attached to each strut to provide a pair of transversely spaced fore pods and a pair of transversely spaced aft pods located beneath said superstructure, propulsion means on each pod on at least one pair of said fore and aft pairs of pods, each pod being configured to have a longitudinal length which is shorter than the length of the ship and a transverse diameter which is large enough to enable the pods to provide all or substantially all of the buoyancy required to maintain said superstructure above the surface of the water during propulsion of the ship at normal operating speeds of the ship, fin means on each pod constructed to provide the turning and to counteract the inertia moment produced during turning of the ship so that the ship does not roll out of a turn, an additional fifth strut extending downwardly from said superstructure and an additional low wave-making resistance hullform pod attached to said fifth strut and located beneath said superstructure to provide additional buoyancy for the ship over and above the buoyancy provided by said pods attached to the first pair of transversely spaced fore struts and the second pair of transversely spaced aft struts, an additional fifth strut extending downwardly from said superstructure and an additional low wave-making resistance hullform pod attached to said fifth strut and located beneath said superstructure to provide additional buoyancy for the ship over and above the buoyancy provided by said pods attached to the first pair of transversely spaced fore struts and the second pair of transversely spaced aft struts, and mounting means for the fifth strut for varying the position of the fifth strut with respect to the superstructure so that the location of the fifth pod can be used to balance the load on the ship.

10. The invention defined in claim 9 wherein the mounting means permit fore and aft longitudinal positioning of the fifth strut.

11. The invention defined in claim 9 wherein the mounting means permit side to side transverse positioning of the fifth strut.

12. The invention defined in claim 9 wherein the mounting means for varying the position of the fifth strut provides both fore and aft and side to side positioning of the fifth strut to permit substantial alignment of the center of buoyancy with the center of gravity of the ship with a load for accommodating the carrying of a variety of loads.

13. The invention defined in claim 9 wherein the mounting means permit vertical positioning of the fifth strut and fifth pod so as to permit complete retraction of the fifth pod out of the water when the added buoyancy of the fifth pod is not needed.

14. A ship of the kind designed to achieve high speed through the use of multiple, low wave-making resistance, submerged hullform pods, said ship comprising, a superstructure constructed for operation above the surface of the water, a first pair of transversely spaced fore struts extending downwardly from said superstructure, a second pair of transversely spaced aft struts extending downwardly from said superstructure, said second pair of aft struts being longitudinally spaced from the first pair of fore struts, a low wave-making resistance hullform pod attached to each strut to provide a pair of transversely spaced fore pods and a pair of transversely spaced aft pods located beneath said superstructure, propulsion means on each pod on at least one pair of said fore and aft pairs of pods, each pod being configured to have a longitudinal length which is shorter than the length of the ship and a transverse diameter which is large enough to enable the pods to provide all or substantially all of the buoyancy required to maintain said superstructure above the surface of the water during propulsion of the ship at normal operating speeds of the ship, fin means on each pod constructed to provide the turning and to counteract the inertia moment produced during turning of the ship so that the ship does not roll out of a turn, an actuating means for retracting the fin means of a pod into the interior of the pod and for projecting the fin means out of the pod with the fin means positioned at a set angle so that the amount of the side force and/or the amount of lift needed can be controlled by the extent to which the fin means are extended outwardly of the pod, wherein the amount to which the fin means are projected out the side of the pod is initially enough to offset the bias of the sinkage of the ship and wherein any additional amount of projection of the fin means out the side of the pod can be produced as needed for any maneuvering and control.

15. The invention defined in claim 14 wherein the fin means are constructed and associated with the actuating means so that the fin means on each pod can be projected from and retracted from both from the outer side of the pod and from the inner side of the pod.

16. The invention defined in claim 14 wherein the fin means of each of the pods is projectable from the associated pod at a location below the midline of the pod and wherein each fin means is inclined downwardly at an angle such that the outer edge of the fin means is positioned at substantially the keel line of the associated pod so that substantially all of the effective force produced by a fin means is exerted above the fin means.

17. The invention defined in claim 14 wherein the propulsion means include a propulsion propeller.

18. A ship of the kind designed to achieve high speed through the use of multiple, low wave-making resistance, submerged hullform pods, said ship comprising, a superstructure constructed for operation above the surface of the water, a first pair of transversely spaced fore struts extending downwardly from said superstructure, a second pair of transversely spaced aft struts extending downwardly from said superstructure, said second pair of aft struts being longitudinally spaced from the first pair of fore struts, a low wave-making resistance hullform pod attached to each strut to provide a pair of transversely spaced fore pods and a pair of transversely spaced aft pods located beneath said superstructure, propulsion means on each pod on at least one pair of said fore and aft pairs of pods, each pod being configured to have a longitudinal length which is shorter than the length of the ship and a transverse diameter which is large enough to enable the pods to provide all or substantially all of the buoyancy required to maintain said superstructure above the surface of the water during propulsion of the ship at normal operating speeds of the ship, and fin means on each pod constructed to permit maneuvering of the ship without the rudder, an additional fifth strut extending downwardly from said superstructure, and an additional low wave-making resistance hullform pod attached to said fifth strut and located beneath said superstructure to provide additional buoyancy for the ship over and above the buoyancy provided by said pods attached to the first pair of transversely spaced fore struts and the second pair of transversely spaced aft struts, wherein the fifth pod is positioned transversely between the pairs of struts and longitudinally between said pairs of struts, and a mounting means for the fifth strut for varying the position of the fifth strut with respect to the superstructure so that the location of the fifth pod can be used to balance the load on the ship.

19. The invention defined in claim 18 wherein the mounting means permit fore and aft longitudinal positioning of the fifth strut.

20. The invention defined in claim 18 wherein the mounting means permit side to side transverse positioning of the fifth strut.

21. The invention defined in claim 18 wherein the mounting means for varying the position of the fifth strut provided both fore and aft and side to side positioning of the fifth strut to permit substantial alignment of the center of buoyancy with the center of gravity of the ship with a load for accommodating the carrying of a variety of loads.

22. The invention defined in claim 18 wherein the mounting means permit vertical positioning of the fifth strut and fifth pod so as to permit complete retraction of the fifth pod out of the water when the added buoyancy of the fifth pod is not needed.

23. The invention defined in claim 18 including propulsion means on said fifth pod.

24. A ship of the kind designed to achieve high speed through the use of multiple, low wave-making resistance, submerged hullform pods, said ship comprising, a superstructure constructed for operation above the surface of the water, a first pair of transversely spaced fore struts extending downwardly from said superstructure, a second pair of transversely spaced aft struts extending downwardly from said superstructure, said second pair of aft struts being longitudinally spaced from the first pair of fore struts, a low wave-making resistance hullform pod attached to each strut to provide a pair of transversely spaced fore pods and a pair of transversely spaced aft pods located beneath said superstructure, propulsion means on each pod on at least one pair of said fore and aft pairs of pods, each pod being configured to have a longitudinal length which is shorter than the length of the ship and a transverse diameter which is large enough to enable the pods to provide all or substantially all of the buoyancy required to maintain said superstructure above the surface of the water during propulsion of the ship at normal operating speeds of the ship, fin means on each pod constructed to permit maneuvering of the ship without the rudder, actuating means for retracting the fin means of a pod into the interior of the pod and for projecting the fin means out of the pod with the fin means positioned at a set angle so that the amount of the side force and/or the amount of lift needed can be controlled by the extent to which the fin means are extended outwardly of the pod, wherein the amount to which the fin means are projected out the side of the pod is initially enough to offset the bias of the sinkage of the ship and wherein any additional amount of projection of the fin means out the side of the pod can be produced as needed for any maneuvering and control.

25. The invention defined in claim 24 wherein the fin means are constructed and associated with the actuating means so that the fin means on each pod can be projected from and retracted from both from the outer side of the pod and from the inner side of the pod.

26. The invention defined in claim 24 wherein the fin means of each of the pods are projectable from the associated pod at a location below the midline of the pod and wherein each fin means is inclined downwardly at an angle such that the outer edge of the fin means is positioned at substantially the keel line of the associated pod so that substantially all of the effective force produced by a fin means is exerted above the fin means.

* * * * *